United States Patent [19]

Kiritani et al.

[11] Patent Number: 4,476,153

[45] Date of Patent: Oct. 9, 1984

[54] PROCESS FOR THE PREPARATION OF PHOTOGRAPHIC RESIN-COATED PAPER

[75] Inventors: Masataka Kiritani; Yasuzi Asao, both of Shizuoka, Japan

[73] Assignee: Fuji Photo Film Co., Ltd., Kanagawa, Japan

[21] Appl. No.: 419,442

[22] Filed: Sep. 17, 1982

[30] Foreign Application Priority Data

Oct. 1, 1981 [JP] Japan ..... 56-156828

[51] Int. Cl.[3] ..... B05D 3/06

[52] U.S. Cl. ..... 427/40; 427/41; 427/326; 427/391; 430/532; 430/537; 430/538

[58] Field of Search ..... 427/40, 41, 316, 326, 427/391; 430/532, 537, 538

[56] References Cited

U.S. PATENT DOCUMENTS

| | | | |
|---|---|---|---|
| 3,411,908 | 11/1968 | Crawford et al. | 430/532 |
| 3,502,298 | 3/1970 | Crawford | 430/538 |
| 3,640,788 | 2/1972 | Flynn | 156/497 |
| 4,188,220 | 2/1980 | Kasugai et al. | 430/538 |
| 4,352,861 | 10/1982 | von Meer et al. | 430/538 |
| 4,389,455 | 6/1983 | Asao | 430/538 |

FOREIGN PATENT DOCUMENTS

| | | | |
|---|---|---|---|
| 2515823 | 10/1976 | Fed. Rep. of Germany | 430/538 |
| 2734090 | 2/1978 | Fed. Rep. of Germany | 430/538 |
| 49-107381 | 10/1974 | Japan | 427/40 |
| 55-113039 | 9/1980 | Japan | 430/538 |
| 55-113040 | 9/1980 | Japan | 430/538 |

*Primary Examiner*—Sadie L. Childs

*Attorney, Agent, or Firm*—Toren, McGeady and Stanger

[57] ABSTRACT

A process for the preparation of a photographic resin-coated paper which comprises subjecting a paper sheet to corona discharge treatment or flame treatment, and then coating the so treated paper sheet with polyolefin resin containing titanium dioxide powder coated with an alcohol having 2–18 carbon atoms and 2–4 hydroxyl groups.

6 Claims, No Drawings

PROCESS FOR THE PREPARATION OF PHOTOGRAPHIC RESIN-COATED PAPER

This invention relates to a process for the preparation of a photographic resin-coated paper.

There has been previously employed, as a photographic support, a baryta paper consisting of a paper sheet coated with baryta layer comprising barium sulfate on one surface. Recently, however, a water-proof photographic support consisting essentially of a paper sheet coated with hydrophobic polyolefin resin on both surfaces thereof has been developed and employed to cope with the requirement for rapid development process, replacing the conventional baryta paper.

The polyolefin resin-coated paper, as described above, generally consists of a paper sheet coated with polyolefin resin. In the polyolefin resin layer placed on one surface of the paper sheet on which a photographic emulsion layer is to be placed, there is generally contained titanium dioxide powder (pigment) for providing high whiteness and high screen.

However, the conventional paper sheet coated with polyolefin resin containing untreated titanium dioxide powder provides, when employed as the paper support for a photographic material, poor resolution to a printed image, and therefore this photographic material is not said to be a satisfactorily qualified commercial good. For this reason, it has been proposed that a surface active agent such as a metallic soap, e.g., calcium stearate or zinc palmitate be incorporated into the polyolefin resin together with the titanium dioxide powder so as to increase dispersion of the titanium dioxide powder therein. The photographic material employing the so prepared photographic paper (support) provides relatively high resolution as compared with the photographic material employing the photographic paper with no surface active agent, but still does not provide a printed image at a satisfactory level.

Also defective is poor adhesion between the polyolefin resin layer containing the untreated titanium dioxide powder and the paper sheet. It is known that the adhesion can be improved by applying an electric, chemical or flame treatment to the paper sheet prior to coating with the polyolefin resin composition. However, the adhesion provided by such a pre-treatments is still at a relatively low level.

Accordingly, a principal object of the invention is to provide a process for the preparation of a photographic resin-coated paper containing titanium dioxide powder in the polyolefin resin coating layer, which is capable of imparting high resolution to a printed image.

Another object of the invention is to provide a process for the preparation of a photographic resin-coated paper having titanium dioxide powder in the polyolefin resin coating layer, which has sufficient adhesion between a paper sheet and the polyolefin resin coating layer.

Other objects of the invention will be seen in the description given below.

The objects of the invention are accomplished by a process for the preparation of a photographic resin-coated paper which comprises subjecting a paper sheet to corona discharge treatment or flame treatment, and then coating the so treated paper sheet with polyolefin resin containing titanium dioxide powder coated with an alcohol having 2–18 carbon atoms and 2–4 hydroxyl groups.

Preferred embodiments of the invention are now described hereinafter.

In the invention, there is no limitation on the titanium dioxide powder, as far as it is applicable to incorporation into a polyolefin resin layer of a photographic paper. For instance, rutile $TiO_2$ powder or anatase $TiO_2$ powder ranging in particle size of 0.1–5 microns is employed. The titanium dioxide powder may be coated with inorganic material such as silica or alumina, or may be treated with an adequate material.

Among these pre-coated or pre-treated powders, anatase-type titanium dioxide powder coated in advance with hydrated alumina in the amount less than 0.5% by weight of the powder is preferred, because it reduces, after coating with the polyhydric alcohol, yellowing with the passage of time of the prepared photographic resin-coated paper and improves the resolution of the photographic material.

Examples of the polyhydric alcohol having 2–18 carbon atoms and 2–4 hydroxyl groups employable in the invention include: alcohols containing 2 hydroxyl groups in the molecule such as ethylene glycol, propylene glycol, 1,3-dihydroxybutane, 1,4-dihydroxybutane, pentamethylene glycol, 2,5-dihydroxyhexane, 2,4-dihydroxy-2-methylpentane, heptamethylene glycol, and dodecamethylene glycol; alcohols containing 3 hydroxyl groups in the molecule such as trimethylolethane, trimethylolpropane, glycerol, 2,4-dihydroxy-3-hydroxylmethylpentane, 1,2,6hexanetriol, and 2,2-bis(-hydroxymethyl)-3-butanol; and alcohols containing 4 hydroxyl groups in the molecule such as pentaerythritol.

Alcohols containing only one hydroxyl group in the molecule, and polyhydric alcohols containing 5 or more hydroxyl groups are ineffective for the improvement of high resolution to a printed image produced on the photographic material.

In the invention, the polyhydric alcohol for coating the titanium dioxide powder preferably contains 2–6 carbon atoms and 2–4 methylol groups. More preferably, the polyhydric alcohol contains 4–5 carbon atoms and 3 methylol groups. Particularly, titanium dioxide powder coated with trimethylolethane is highly effective for the improvement of high resolution to a printed image produced on the photographic material.

The polyhydric alcohol is preferably coated over the surface of the titanium dioxide powder in the amount of approximately 0.01–10% by weight of the titanium dioxide powder. Particularly preferred range of the coating amount is approximately 0.1–1.5% by weight of the same. The polyhydric alcohol more than 10 % by weight causes increased emitting of smoke and offensive odor in the melt extrusion process, resulting in deterioration of the working atmosphere.

The coating of the titanium dioxide powder with the polyhydric alcohol can be accomplished in a variety of ways. Examples of the coating procedures include: a procedure comprising immersing the titanium dioxide powder in a solvent containing the polyhydric alcohol, recovering the powder from the solution, and removing the solvent from the so recovered titanium dioxide powder through volatilization; a procedure comprising spraying a solvent containing the polyhydric alcohol over the titanium dioxide powder, and removing the solvent from the powder through volatilization; a process comprising mixing a molten polyhydric alcohol with the titanium dioxide powder; and a process comprising pulverizing solid titanium dioxide in the presence of the polyhydric alcohol. Industrially preferred processes are a process comprising pulverizing the titanium dioxide in a hydrodynamic pulverizer such as a micronizer or a jet mill under adding the polyhydric alcohol; and a process comprising mixing the titanium dioxide powder with the polyhydric alcohol in a high shearing mixer such as a Henschel mixer or a super mixer.

The titanium dioxide powder coated with the polyhydric alcohol is incorporated into a polyolefin resin generally in the amount of approximately 1-40% by weight, preferably 5-20% by weight, of the resin, in view of whiteness and screening effect.

In the invention, the polyolefin resin preferably has melt index (MI) in the range of 1-40 g./10 min., more preferably 5-30 g./10 min. This melt index value is determined in accordance with the measurement procedure defined in JIS K 6760—1966.

Examples of the polyolefin resins of the invention include ethylene homopolymers such as high density polyethylene and low density polyethylene, propylene homopolymers, and copolymers of ethylene with one or more copolymerizable monomers. When the ethylene copolymer is selected, the copolymerizable monomer preferably amounts to not more than 10% by weight of the ethylene content. Examples of the copolymerizable monomers include alfa-olefins such as styrene, vinyl stearate, vinyl acetate, acrylic acid, methyl acrylate, ethyl acrylate, acrylamide, methacrylic acid, methyl methacrylate, ethyl methacrylate, methacrylamide; and diene compounds such as butadiene and isoprene. The polyolefin resin can be employed alone or in combination.

Incorporation of the titanium dioxide powders coated with the polyhydric alcohol into the polyolefin resin can be carried out by a conventional method such as the melt extrusion process using a kneading extruder, a heating roll mill, a Banbury mixer, or a kneader.

Preferably, the incorporation of the coated titanium dioxide powder into the polyolefin resin is carried out through preparation of a master batch. More in detail, the coated titanium dioxide powder is incorporated into the polyolefin resin in the amount of approximately 10-60% by weight, preferably 20-40% by weight, of the resin. The so prepared polyolefin resin composition containing a large amount of the coated titanium dioxide powder is diluted with a simple polyolefin resin when subjected to the melt extrusion.

The polyolefin resin composition may further contain a variety of additives such as fluorescent whitening agent, antioxidizing agent, antistatic agent, releasing agent, dye and dispersing agent, if desired.

There is no limitation on material of the paper sheet, as far as the material is able to serve as support of a photographic material. Examples of the materials of the paper sheet include natural pulp, synthetic pulp, and their mixtures. The thickness of the paper sheet generally ranges from approximately 20$\mu$ to approximately 400$\mu$, and preferably ranges from 70$\mu$ to 250$\mu$. The basis weight of the paper sheet generally ranges from approximately 15 g./m$^2$ to approximately 350 g./m$^2$, and preferably ranges from 50 g./m$^2$ to 200 g./m$^2$. The paper sheet may contain conventional agent such as paper strength increasing agent, sizing agent, dye, fluorescent whitening agent, a preserving agent, filler, and antistatic agent, if desired.

In the process of the invention, the paper sheet is subjected to a surface activation treatment selected from those consisting of corona discharge treatment and flame treatment, in advance of coating with the polyolefin resin composition.

The corona discharge treatment is known to those skilled in the art and can be carried out in the manner disclosed in U.S. Pat. No. 3,411,908. The corona discharge treatment for the invention is preferably carried out at 1-10 kVA.sec/m$^2$, more perferably 2-6 kVA.sec/m$^2$.

The flame treatment is also known to those skilled in the art and can be carried out in the manner disclosed in Japanese Patent Provisional publication No. 52(1977)-121,683 and U.S. Pat. No. 3,640,788. The flame can be prepared by burning paraffinic or olefinic hydrocarbon gas with oxygen. Preferred examples of the hydrocarbon gases include methane, ethane, propane, ethylene, and propylene. A mixture of these gases can be also employed.

In the flame treatment, the flame can be applied through a burner to a surface of a paper sheet running at a rate of 50-400 m/min.

The so treated paper sheet is then coated with the polyolefin resin containing the titanium dioxide powder coated with the aforementioned polyhydric alcohol and, if desired, further containing one or more additives, for instance, through melt extrusion. The thickness of the polyolefin resin layer coated on the surface of the paper sheet is in the range of approximately 5-200$\mu$, preferably 10-40$\mu$.

In the present specification, the (melt) extrusion means a procedure comprising coating a running paper sheet with polyolefin resin composition in the form of film extruded in molten state through a slit die from an extruder. In the procedure, the polyolefin resin composition is in molten state under heating to approximately 250°-350° C., preferably 280°-320° C. The paper sheet is running at a rate of approximately 50-500 m/min., preferably 80-250 m/min. Examples of the slit dies include flat dies such as T-die, L-die and fishtail dye. The slit gap preferably ranges from approximately 0.1 to 1.5 mm.

The so prepared polyolefin resin-coated paper can be given further treatments generally applied to a conventional photographic support, if desired. These treatments are known to those skilled in the art and exemplified by a hydrophilic treatment for improving the adhesion of the resin surface to a photographic emulsion layer, and a patterning treatment by means of a patterning roll having an engraved pattern thereon to produce an embossed pattern on the surface of the resin layer.

The present invention is now illustrated by the following examples, but these examples by no means restrict the invention.

In the examples, the resolution (resolving power) was evaluated in the following manner.

A polyolefin resin-coated paper is coated with a photographic emulsion, and a resolution evaluation test piece consisting of series of alternating black and white lines of increasing narrowness set in geometric patterns is printed thereon. The variation of optical density of the printed chart image is then determined with Microphotometer (microdensitometer produced by Union Optics Co., Ltd., Japan).

The so determined values are processed in accordance with the formula shown below to give the resolution value.

$$\text{Resolution Value (\%)} = \frac{\text{Difference of optical density between the exposed portion and the unexposed portion of 5 lines/mm-piece printed image}}{\text{Difference of optical density between the exposed portion and the unexposed portion of 0.1 line/mm-piece printed image}} \times 100$$

The so calculated resolution value has close relationship with a visual evaluation result, and indicates that a high value means high resolution.

EXAMPLE 1

A paper sheet weighing about 150 g/m$^2$ containing a mixture of sizing agents consisting of polyamide-polyamine-epichlorohydrin, cationic polyacrylamide, anionic polyacrylamide, and alkylketene dimer was passed under a corona discharge generated by 4 kVA.sec/m$^2$ through a corona discharge treatment apparatus (produced by Pillar Corp.).

The paper sheet was then coated with a polyethylene (density: 0.920 g./cc., MI: 5.0 g./10 min.) containing a titanium dioxide powder in the amount of 10% by weight of the polyethylene, through melt extrusion at a temperature of 285° C., to prepare a polyethylene coating layer of thickness of 30$\mu$. The titanium dioxide powder employed was an anatase-type titanium dioxide powder treated preliminarily with hydrated alumina and then coated with trimethylolethane in the amount of 1.0% by weight of the titanium dioxide powder.

The so prepared resin-coated paper was further treated with the corona discharge so that the surface of the resin layer was made hydrophilic, and a photographic silver halide emulsion was placed thereon to prepare a photographic material.

The photographic material was printed with a test piece for the evaluation of resolution, and evaluated for the resolution. The resolution value was as high as 56%.

The photographic material had so high adhesion between the paper sheet and the polyethylene resin layer that it did not occur to release the resin layer therefrom in the development stage, fixing stage, and other stages.

EXAMPLE 2

The process of Example 1 was carried out except that the titanium dioxide powder coated with the same amount of trimethylolpropane in place of the trimethylolethane was employed, to prepare a photographic material.

The photographic material was printed with the test piece, and evaluated for the resolution. The resolution value was as high as 54%.

The photographic material had so high adhesion between the paper sheet and the polyethylene resin layer that it did not occur to release the resin layer therefrom in the development stage, fixing stage, and other stages.

COMPARISON EXAMPLE 1

The process of Example 1 was carried out except that the corona discharge treatment was not given to the paper sheet and that a simple titanium dioxide powder with no coating treatment was employed, to prepare a photographic material.

The photographic material was printed with the test piece, and evaluated for the resolution. The resolution value was 47%.

The photographic material released a part of the resin layer therefrom in the development stage, fixing stage and other stages.

We claim:

1. A process for the preparation of a photographic resin-coated paper which comprises subjecting paper sheet to corona discharge treatment and then coating the so treated paper sheet with polyolefin resin containing titanium dioxide powder coated with an alcohol selected from the group consisting of trimethylolethane, trimethylolpropane and 2,4-dihydroxy-2-methylpentane.

2. The process as claimed in claim 1, in which the alcohol is coated over the titanium dioxide powder in the amount of about 0.01 to about 10 percent by weight of the titanium dioxide powder.

3. The process as claimed in claim 1, in which the alcohol is coated over the titanium dioxide powder in the amount of about 0.1 to about 1.5 percent by weight of the titanium dioxide powder.

4. The process as claimed in claim 1, in which the titanium dioxide powder is coated with inorganic material in advance of coating with the alcohol.

5. The process as claimed in claim 4, in which the inorganic material is silica or alumina.

6. The process as claimed in claim 1, in which the polyolefin resin is polyethylene resin.

* * * * *